US011313003B2

(12) United States Patent
Reinartz et al.

(10) Patent No.: US 11,313,003 B2
(45) Date of Patent: Apr. 26, 2022

(54) TEMPERATURE CONTROL STATION FOR PARTIALLY THERMALLY TREATING A METAL COMPONENT

(71) Applicant: SCHWARTZ GMBH, Simmerath (DE)

(72) Inventors: Andreas Reinartz, Monschau (DE); Jörg Winkel, Nideggen-Schmidt (DE); Frank Wilden, Simmerath (DE)

(73) Assignee: SCHWARTZ GMBH, Simmerath (DE)

( * ) Notice: Subject to any disclaimer, the term of this patent is extended or adjusted under 35 U.S.C. 154(b) by 242 days.

(21) Appl. No.: 16/603,415

(22) PCT Filed: Mar. 28, 2018

(86) PCT No.: PCT/EP2018/057945
§ 371 (c)(1),
(2) Date: Oct. 7, 2019

(87) PCT Pub. No.: WO2018/184947
PCT Pub. Date: Oct. 11, 2018

(65) Prior Publication Data

US 2020/0040415 A1 Feb. 6, 2020

(30) Foreign Application Priority Data

Apr. 7, 2017 (DE) ..... 10 2017 107 549.6

(51) Int. Cl.
*C21D 1/667* (2006.01)
*C21D 9/00* (2006.01)
(Continued)

(52) U.S. Cl.
CPC ..... *C21D 1/667* (2013.01); *C21D 1/18* (2013.01); *C21D 9/0062* (2013.01); *C21D 9/46* (2013.01); *C21D 2221/00* (2013.01)

(58) Field of Classification Search
CPC ..... C21D 1/18; C21D 1/667; C21D 2221/00; C21D 9/0062; C21D 9/46; C21D 9/48
(Continued)

(56) References Cited

U.S. PATENT DOCUMENTS 3,881,907 A * 5/1975 Starr ..... C03B 27/0404 65/114
4,367,597 A * 1/1983 Iida ..... C21D 9/573 134/102.1
(Continued)

FOREIGN PATENT DOCUMENTS

DE 102008039264 A1 3/2010
DE 102012021576 5/2013
(Continued)

*Primary Examiner* — Jessee R Roe
*Assistant Examiner* — Michael Aboagye
(74) *Attorney, Agent, or Firm* — Occhiuti & Rohlicek LLP

(57) ABSTRACT

A tempering station for the partial heat treatment of a metal component, which includes an apparatus for the heat treatment of a metal component, and the use of at least one tangential nozzle in a tempering station for the partial heat treatment of a metal component. The tempering station for partial heat treatment of the metallic component comprises a processing plane disposed in the tempering station, the component being able to be disposed in said plane, and at least one nozzle which points to the processing plane and is provided and adapted for discharging a fluid stream for cooling at least a first sub-area of the component, wherein the at least one nozzle is a tangential nozzle. The tempering station and the apparatus make it possible in particular to adjust, as reliably and/or precisely as possible, a transition region between the different heat-treated sub-areas of the component, in particular to keep said region as small as possible.

7 Claims, 1 Drawing Sheet

(51) Int. Cl.
*C21D 1/18* (2006.01)
*C21D 9/46* (2006.01)

(58) Field of Classification Search
USPC ..... 266/46, 259; 164/444, 126, 455, 485
See application file for complete search history.

(56) References Cited

U.S. PATENT DOCUMENTS

| | | | | |
|---|---|---|---|---|
| 4,834,344 | A * | 5/1989 | Hoetzl | C21D 1/667 266/117 |
| 5,640,872 | A * | 6/1997 | Plata | B05B 7/0861 72/201 |
| 8,858,735 | B2 * | 10/2014 | Kondo | C23C 2/28 148/320 |
| 9,951,395 | B2 * | 4/2018 | Shimotsu | C22C 38/00 |
| 2014/0250963 | A1 * | 9/2014 | Nelson | B21B 45/0209 72/12.7 |
| 2020/0232053 | A1 * | 7/2020 | Wilden | C21D 1/673 |

FOREIGN PATENT DOCUMENTS

| | | |
|---|---|---|
| DE | 102013101489 | 6/2014 |
| DE | 102015112293 | 2/2017 |

* cited by examiner

TEMPERATURE CONTROL STATION FOR PARTIALLY THERMALLY TREATING A METAL COMPONENT

CROSS REFERENCE TO RELATED APPLICATIONS

This application is a National Phase under 35 U.S.C. 371 of International Application No. PCT/EP2018/057945 filed on Mar. 28, 2018, which claims priority to German Application No. 10 2017 107 549.6 filed Apr. 7, 2017, the contents of which are hereby incorporated by reference in their entirety.

BACKGROUND OF THE INVENTION

The invention relates to a tempering station for the partial heat treatment of a metal component, an apparatus for the heat treatment of a metal component, and the use of at least one tangential nozzle in a tempering station for the partial heat treatment of a metal component. The invention can in particular be used in connection with a press-hardening line in which a continuous-flow furnace, in particular a roller hearth furnace, is followed by a press-hardening tool.

For the manufacture of safety-related vehicle body parts made of sheet metal, it is usually necessary to harden the metal sheet during or after the forming of the body component. For this purpose, a heat treatment process has been established, which is referred to as "press-hardening". Here, the steel metal, which is usually provided in the form of a panel, is first heated in a furnace and then cooled and thereby cured in a press during the forming process.

For some years now there have been efforts to prepare motor vehicle body components by means of press hardening, such parts including, for example, A- and B-pillars, side impact protection supports in doors, sills, frame parts, bumpers, cross members for floors and roofs, and front and rear side components, the parts having different strengths in different sub-areas so that the body component can partially fulfill different functions. For example, the central area of a B-pillar of a vehicle should have high strength to protect the occupants in the event of a side impact. At the same time, the upper and lower end area of the B-pillar should have a comparatively low strength in order to both absorb deformation energy during a side impact and to facilitate ease of connectability to other body components during the assembly of the B-pillar.

To form such a partially hardened body component, it is necessary for the hardened component to have different strength properties in the different sub-areas. For this purpose, for example, it is possible to arrange one or more tempering station(s) between the furnace and the press-hardening tool. In this case, the tempering station is provided and set up to establish different temperatures in the sub-areas of the component, which is initially heated uniformly, so that different strength properties in the sub-areas result during the subsequent press hardening. Optimal cycle times, which play an important role in the vehicle industry in particular, can be achieved in this case, in particular if the furnace, tempering station and press-hardening tool elements are arranged in succession.

It has proven to be advantageous if, in the hardened component, one or more specific sub-areas of the component which are to have a higher ductility or lower strength than other, hardened sub-areas of the component are cooled in a targeted manner in the tempering station, in particular while the other component sub-areas to be hardened are kept at a high temperature. In this context, in order to cool the one or more specific sub-areas of lesser strength it has been found to be particularly advantageous if air is blown at high speed through nozzles onto the corresponding sub-area or sub-areas of the component.

In the case of such air cooling, however, there is often the problem that the boundary which arises in the component between the sub-areas of different strength, which is also referred to as the transition region, is not clearly enough definable and/or exactly enough adjustable. In order to achieve the most exact adjustability of the transition region, partition walls are usually used, also referred to as bulkhead walls, which are arranged next to the nozzles in the tempering station and which are provided and adapted to (thermally) delimit the respective sub-areas of different strength. For this purpose, the partitions may possibly even touch the component, however, it is usually the case that as small as possible of a gap should be maintained between the lower end of the respective partition wall and the component.

It may happen that the gap between the partition wall and the component is not small enough to reliably prevent possible leakage of cold air to the hotter sub-area of the component, which is to be kept hot. This leads to an unwanted blurring in the transition region, which usually causes the transition region to be larger than necessary or than it is desired. It can also be the case that an unwanted gap enlargement occurs, for example due to warping of the hot component or insufficiently precise positioning of the component. However, the automotive industry is placing a great deal of value on the smallest possible transition regions so that subsequent crash behavior in previous designs, in particular in previous simulations of crash behavior, can be better simulated. Therefore, there is an increasing desire to be able to adjust the transition regions as exactly and small as possible, which is particularly difficult due to the leaks occurring in previous tempering stations between the partition wall and the component.

BRIEF SUMMARY OF THE INVENTION

On this basis, it is an object of the present invention to at least partially solve the problems described in the prior art. In particular, a tempering station and a device for heat treatment of a metal component are indicated which allow the adjustment of a transition region between the different heat-treated sub-areas of the component as reliably and/or precisely as possible, in particular to keep the transition region as small as possible. In addition, the tempering station and the device should in particular allow one to no longer require the component to be in contact with a partition wall for (thermally) delimiting the differently-tempered sub-areas of the component.

These objects are achieved by the features of the independent claims. Further advantageous embodiments of the solution proposed here are specified in the dependent claims. It should be noted that the features listed individually in the dependent claims can be combined with each other in any technologically reasonable manner which then define further embodiments of the invention. In addition, the features specified in the claims are described and explained in more detail in the description, further preferred embodiments of the invention being thereby shown.

A tempering station according to the invention for the partial heat treatment of a metallic component comprises at least one (horizontal) processing plane disposed in the tempering station, the component being able to be disposed in said plane, and at least one nozzle which points at the processing plane and is provided and adapted for discharging a fluid stream for cooling at least a first sub-area of the component. The at least one nozzle is a tangential nozzle.

The tangential nozzle is characterized in particular in that it generates and/or discharges a fluid stream at at least one nozzle outlet, the stream having at least one directional component or one streamline which is aligned substantially tangentially and/or parallel to the processing plane and/or a surface of the component. The terms "substantially tangential" and "substantially parallel" here include, in particular, deviations from the ideal form ("tangential" or "parallel") within a range of −10° to +20° [degrees], preferably 0° to 20°. The tangential nozzle preferably generates a horizontal stream downstream of the nozzle outlet thereof.

For this purpose, a plane in which a nozzle outlet cross-section or an opening of a nozzle outlet of the tangential nozzle is arranged includes an angle of 0° to 135° [degrees], preferably from 0° to 75° and in particular 20° to 75° with the (horizontal) processing plane. In particular, the tangential nozzle helps to direct the air such that any air pulse in the direction of a second sub-area of the component is prevented at the nozzle exit. It is particularly preferred if a nozzle outlet or a nozzle outlet opening of the tangential nozzle faces or is directed toward the first sub-area of the component and/or faces or is directed away from a second sub-area of the component.

The solution presented here advantageously makes it possible to provide a type of "aerodynamic seal" in the direction of the second sub-area of the component. This contributes to there being substantially no leakage of the fluid stream which reaches as far as the second sub-area of the component, which sub-area should not change its high component temperature, or only very little, during the cooling of the first sub-area in the tempering station so that the second sub-area can cure. This makes it possible to represent very sharply delineated transition regions in an advantageous manner. In particular, a transition region achievable by means of the solution presented here is approximately in the range of 1 mm to 60 mm [millimeters]. In an advantageous application of the solution presented here, the size, in particular width, of the transition region is mainly (only) determined by the physically unavoidable heat conduction in the component. The solution presented here makes it easy to produce soft outer flanges on hard components, for example.

The metal component (to be treated using the tempering station) is preferably a metal panel, a steel sheet or an at least partially preformed semi-finished product. The metal component is preferably made with or from a (hardenable) steel, for example a boron (manganese) steel, e.g. 22MnB5 steel. More preferably, the metal component is provided with a (metal) coating or is precoated, at least for the most part. The metal coating may be, for example, a (predominantly) zinc-containing coating or a (predominantly) aluminum- and/or silicon-containing coating, in particular a so-called aluminum/silicon (Al/Si) coating. However, the metallic component (alternatively) may also compose or be made from aluminum or an aluminum alloy.

The tempering station is preferably arranged downstream of a first furnace and/or upstream of a second furnace. A processing plane is disposed in the tempering station, the component being disposed or disposable in said plane. In this case, the processing plane designates in particular the plane into which the component can be moved for treatment in the tempering station and/or in which the component is arranged and/or fixable in the tempering station during the treatment. Preferably, the processing plane is aligned substantially horizontally.

The tempering station has at least one nozzle. The nozzle points toward the processing plane. In addition, the nozzle is provided and adapted to discharge a fluid stream for cooling at least a first sub-area of the component, in particular so that a temperature difference between the at least one first sub-area (which is ductile in the finished treated component) and at least a second sub-area of the component (a harder area in the finished treated component by comparison) is adjustable. Preferably, a plurality of nozzles is provided, wherein the nozzles are particularly preferably arranged as a nozzle field. If a plurality of nozzles is provided, at least one of the nozzles is a tangential nozzle.

The fluid stream is preferably composed of a cooling fluid. The cooling fluid may compose a gas, such as nitrogen or with a gas mixture, in particular air. In addition, the cooling fluid may compose a gas-liquid mixture, such as an air-water mixture.

In addition to the at least one nozzle designed as tangential nozzle, the tempering station can have one or more additional nozzles which have a different, in particular structurally simpler, nozzle geometry. Thus, in addition to the at least one (tangential) nozzle, at least one further nozzle may be provided, which has or forms, in particular surrounds, at least one nozzle channel extending substantially perpendicular to the processing plane. The further nozzle is preferably disposed adjacent to the (tangential) nozzle in the tempering station, but in particular not between the (tangential) nozzle and a partition wall. In this case, the additional nozzle and the (tangential) nozzle can be kept at the same height within the tempering station and/or above the processing plane. Preferably, the at least one further nozzle is formed in the manner of a shower. In other words, this means in particular that the at least one further nozzle has a plurality of outlet openings on an underside pointing towards the processing plane.

In particular, in the event that large-area first sub-areas of the component are to be cooled, a combination of (tangential) nozzles and other nozzles, each formed in the manner of a shower (also known as "shower heads"), is advantageous. In this case, it is particularly advantageous if the (tangential) nozzles are disposed in the area of a partition wall and the further nozzles (in comparison thereto) are disposed more towards the center of the first sub-area of the component to be cooled. If the inherent stress-induced deformation of the component on large surfaces increases in such a way that dead zones with a lower flow velocity can arise behind the raised portions when the flow is purely horizontal (from the tangential nozzles), this leads to slower cooling in places. Therefore, flow along large surfaces should (also) be vertical. The vertical flow can be provided in a particularly advantageous manner by providing one or more further nozzles, in addition to the at least one (tangential) nozzle, which are each formed in the manner of a shower.

According to an advantageous embodiment, it is proposed that a nozzle geometry of the at least one nozzle is designed so that at least one element of the fluid stream (within the nozzle) flowing in the direction of a second sub-area of the component is deflected towards the first sub-area of the component. Preferably, the element of the fluid stream within the nozzle and/or immediately upstream of a nozzle outlet opening is deflected towards the first sub-area.

According to a further advantageous embodiment, it is proposed that the nozzle geometry of the at least one nozzle is designed such that at least one element of the fluid stream first flows through the nozzle in a direction towards a second sub-area of the component and then is deflected towards the first sub-area. Preferably, the fluid stream is deflected from a deflection region of the nozzle toward the first sub-area, wherein the deflection region is usually arranged (directly) upstream of a nozzle outlet and/or a nozzle outlet opening.

According to an advantageous embodiment, it is proposed that the nozzle geometry of the at least one nozzle is designed such that the fluid stream (the entire stream flowing through the respective nozzle) first flows through the nozzle in a direction toward a second sub-area of the component and is then diverted to the first sub-area (Immediately) after the deflection of the fluid stream toward the first sub-area, the fluid stream can leave the at least one nozzle substantially tangentially and/or parallel to the processing plane and/or a surface of the first sub-area of the component.

The nozzle geometry of the at least one nozzle is preferably designed so that at least one element of the fluid stream, at least one (central) streamline of the fluid stream or even the entire fluid stream flowing through the respective nozzle flows through the nozzle (initially) in a first direction, then is deflected and then flows through the nozzle in a second direction. In this case, the first direction (predominantly) has a radially-outwardly directed direction component and the second direction (predominantly) has a radially-inwardly directed direction component. The indications "radially-outwardly" and "radially-inwardly" are defined with respect to a nozzle inlet section or nozzle inlet channel running substantially perpendicular to the processing plane. The fluid stream thus normally passes, initially or at first, through a nozzle inlet section or nozzle inlet channel running substantially perpendicular to the processing plane on its way through the nozzle, is then directed radially-outwardly, then deflected so that it is directed radially-inwardly in the region of a nozzle outlet or toward the nozzle outlet.

Preferably, the at least one nozzle has a deflection region. The deflection region is particularly preferably at least partially bent or curved. The deflection region can be disposed immediately upstream of a nozzle outlet.

According to an advantageous embodiment, it is proposed that a nozzle outlet of the at least one nozzle is designed, aligned and/or disposed relative to a deflection region of the nozzle such that a (each) flow impulse in the direction of a second sub-area of the component is prevented at the nozzle outlet. Preferably, the nozzle outlet is disposed downstream and/or after a curvature of the nozzle geometry, a curvature section of the nozzle and/or a deflection region of the nozzle. Preferably, a concave inner side of the curvature, of the curvature section or of the deflection region points towards the first sub-area of the component. Furthermore, a convex outer side of the curvature, of the curvature section or of the deflection region preferably points towards a second sub-area of the component. Particularly preferably, the nozzle outlet points (directly) toward the first sub-area and/or in the direction of the first sub-area.

Furthermore, the at least one nozzle is preferably disposed adjacent to and/or (directly) in the region of a partition wall, which delimits the first sub-area from a second sub-area of the component (thermally). In this case, the partition wall may be a part of the tempering station and/or (in any case) disposed above the component. Moreover, it is preferred if the at least one nozzle has a bent design. Particularly preferably, the at least one nozzle is bent in such a way that a nozzle exit of the at least one nozzle has a smaller (horizontal) distance to the partition wall than a nozzle inlet of the at least one nozzle. A particular result of the bent design can be that the nozzle outlet is very close to or even at least partially below the partition wall and thus can be disposed very close to the transition region to be created, and there can still be sufficient remaining space between the nozzle inlet and the partition wall for permanent thermal insulation to be placed at the partition wall.

According to an advantageous embodiment, it is proposed that the at least one nozzle has a deflection region which extends towards and/or at least partially below a partition wall which delimits the first sub-area from a second sub-area of the component. The partition wall is preferably a part of the tempering station and usually disposed (in any case) above the component. Preferably, a convex outer side of the deflection region is directed towards the partition wall and/or towards a second sub-area of the component.

According to an advantageous embodiment, it is proposed that the at least one nozzle, in particular a deflection region of the at least one nozzle, is designed such that the fluid stream generates a negative pressure area at a side pointing towards the processing plane and/or at an area of the nozzle pointing towards a second sub-area of the component. The negative pressure area here is an area with a reduced pressure compared to ambient pressure. Preferably, a flow impulse in the direction of the first sub-area of the component is adjusted or set by the geometry of the deflection region in such a way that a (slight) negative pressure is created at the underside of the nozzle. Due to the resulting ejector effect even a little warm air can be pulled from the hot zone of the tempering station, in other words the area above or below a second sub-area of the component. Due to the low density of the hot air and the small amount thereof, the effect on the cold side, i.e. above or below the first sub-area of the component, is usually negligible. Thus, a very sharply defined transition region can be represented in a particularly advantageous manner.

According to an advantageous embodiment, it is proposed that a distance between the processing plane and the at least one nozzle is adjustable or adjusted such that the at least one nozzle does not contact the component. Preferably, the distance is in the range of 0.01 mm to 6 mm [millimeters], more preferably in the range of 0.5 mm to 5 mm or even in the range of 1 mm to 3.5 mm.

Preferably, the nozzle geometry and/or an outer contour of the nozzle is designed such that the above-described negative pressure area itself or in particular arises when the nozzle does not contact the component. Thus, the solution presented here can be made very tolerant to errors with respect to positioning errors and/or temperature-related or intrinsic stress-related geometric errors of the component.

Further preferably, the at least one nozzle in the tempering station is movable, in particular displaceably held or mounted. By attaching the nozzle to be correspondingly variable, the exact position of the transition region in the horizontal direction can be easily readjusted in an advantageous manner.

Preferably, at least one heat source is disposed in the tempering station, the heat source being held (thermally) separated from the at least one nozzle in the tempering station. Here, the heat source and the nozzle are separated and/or shielded from one another (thermally) by means of a partition wall. The at least one heat source is preferably at least one radiant heat source. The heat source is preferably an actively-operable, in particular electrically-operable or energizable, heat source. Particularly preferably, the heat source composes an electrically-operated heating element (not physically or electrically contacting the component). The heating element may be a heating loop, a fully ceramic heating element and/or a heating wire. Alternatively or additionally, the heat source may compose a (gas-heated) radiant tube. Advantageously, the heat source and the nozzle are held in a nozzle box disposed in the tempering station, wherein the nozzle box has at least one partition wall between the heat source and the nozzle. It is particularly preferred for a nozzle outlet or a nozzle outlet opening of the tangential nozzle to point or be directed away from the heat source.

According to a further aspect, an apparatus for (partial) heat treatment of a metal component is proposed, comprising at least:

one first furnace which can be heated, in particular by means of radiant heat and/or convection, one tempering station downstream of the first furnace.

According to an advantageous embodiment, it is proposed that the apparatus further comprises at least:

one second furnace downstream of the tempering station, in particular heated by means of radiant heat and/or convection heating, and/or one press-hardening tool downstream of the tempering station and/or the second furnace.

The press-hardening tool is in particular provided and adapted to simultaneously or at least partially reshape the component to parallel and to quench it (at least partially). The press-hardening tool may be part of a press or may be composed of a press. Preferably, the first furnace, the tempering station, the second furnace and the press-hardening tool (in the stated order) are arranged, in particular, directly one after the other. However, a distance to be bridged by at least one handling device may be provided between the first furnace and the tempering station, between the tempering station and the second furnace and/or between the second furnace and the press-hardening tool, the distance to be bridged preferably being at least 0.5 m [meters].

It is particularly advantageous if at least the first furnace or the second furnace is a continuous furnace or a chamber furnace. Preferably, the first furnace is a continuous furnace, in particular a roller hearth furnace. The second furnace is particularly preferably a continuous furnace, in particular a roller hearth furnace, or a chamber furnace, in particular a multilayer furnace with at least two chambers arranged one above the other. The second furnace preferably has a furnace interior, in particular (exclusively) which can be heated by means of radiant heat, in which preferably a (virtually) uniform internal temperature can be set. In particular, when the second furnace is designed as a multi-layer chamber furnace, a plurality of such furnace interior spaces may be present, corresponding to the number of chambers.

Radiant heat sources are preferably (exclusively) arranged in the first furnace and/or in the second furnace. Particularly preferably, at least one electrically operated (component non-contacting) heating element, such as at least one electrically operated heating loop and/or at least one electrically operated heating wire is arranged in a furnace interior of the first furnace and/or in a furnace interior of the second furnace. Alternatively or additionally, at least one, in particular gas-heated, radiant tube can be disposed in the furnace interior of the first furnace and/or the furnace interior of the second furnace. Preferably, a plurality of radiant tube gas burners or radiant tubes are disposed in the furnace interior of the first furnace and/or the furnace interior of the second furnace, into each of said burners or tubes at least one gas burner burns. In this case, it is particularly advantageous if the inner area of the steel tubes into which the gas burners burn is atmospherically separated from the furnace interior so that no combustion gases or exhaust gases can enter the furnace interior and thus influence the furnace atmosphere. Such an arrangement is also referred to as "indirect gas heating".

The details, features and advantageous embodiments discussed in connection with the tempering stations can accordingly also occur in the apparatus presented here, and vice versa. In that regard, reference is made in full to the explanations given about them for a more detailed characterization of the features.

According to a further aspect, use of at least one tangential nozzle is proposed in a tempering station for partial heat treatment of a metallic component, in particular for partial cooling of a first sub-area of the component. Preferably, the tangential nozzle is used to discharge a substantially horizontally-oriented airflow flowing along a surface of a first sub-area of the component in order to cool the first sub-area for the purposes of (in comparison to a second sub-area) lower the strengths thereof in the finished state of the heat-treated (i.e. press-hardened) component. In this case, the tangential nozzle can be aligned in such a way that the air flow flows from an (adjustable) edge or a contour of the first sub-area and/or from a partition wall to a center of the first sub-area.

The details, features and advantageous embodiments discussed in connection with the tempering stations and/or the device can accordingly also occur with the use presented here, and vice versa. In that regard, reference is made in full to the explanations given about them for a more detailed characterization of the features.

The invention and the technical environment will be explained in more detail with reference to the figures. It should be noted that the invention should not be limited by the exemplary embodiments shown. In particular, unless explicitly stated otherwise, it is also possible to extract partial aspects from the facts explained in the figures and to combine them with other components and/or insights from other figures and/or from the present description. The figures show:

DETAILED DESCRIPTION OF THE INVENTION

Figure 1:
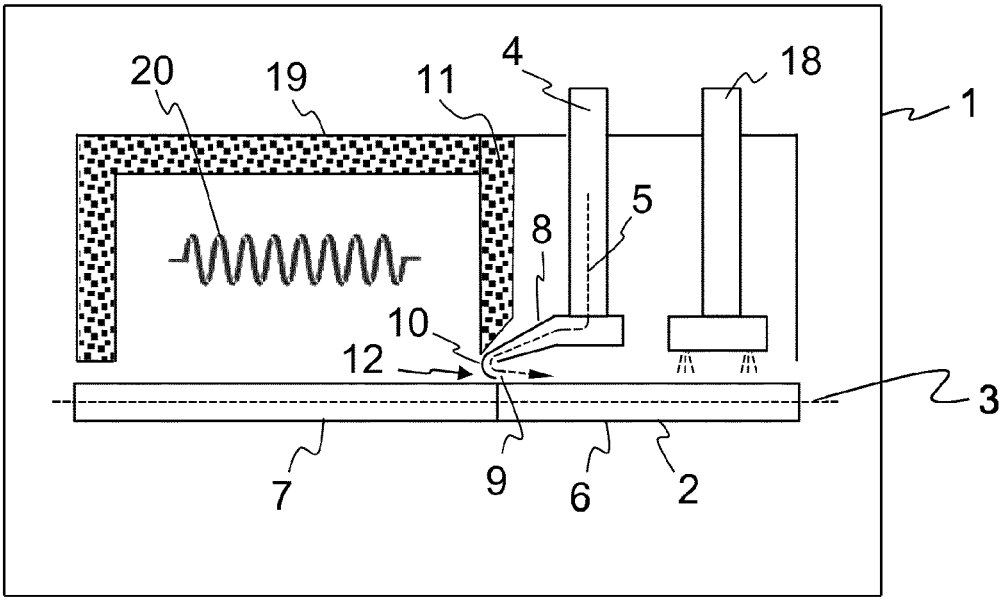
FIG. 1: a schematic representation of a tempering station according to the invention.

FIG. 1 shows a schematic representation of a tempering station 1 for the partial heat treatment of a metal component 2. A processing plane 3 is disposed in the tempering station 1, in which the component 2 is located. In addition, a nozzle 4 is disposed in the tempering station 1, as an example here, which points toward the processing plane 3 and is provided for discharging a fluid stream 5 (shown in dashed lines in FIG. 1) for cooling a first sub-area 6 of the component 2.

In addition, FIG. 1 illustrates that the nozzle 4 is a tangential nozzle 13. This is characterized in that at a nozzle outlet 9 of the nozzle 4, the nozzle generates a fluid stream 5 which substantially points tangentially or parallel to a surface of the component 2, in this case to a surface of the first sub-area 6 of the component 2. This orientation is illustrated by the arrow at the end of the fluid stream 5 shown in dashed lines.

Furthermore, a nozzle geometry 8 (shown in section in FIG. 1) of the nozzle 4 is designed such that at least one element of the fluid stream 5 flowing in the direction of a second sub-area 7 of the component 2 is deflected towards the first sub-area 6. According to the illustration according to FIG. 1, the nozzle geometry is even designed such that the entire fluid stream 5 flowing through the nozzle 4 initially flows through the nozzle 4 in one direction towards a second sub-area 7 of the component 2 and then is deflected toward the first sub-area 6 of the component 2. For deflecting the fluid stream 5 toward the first sub-area 6, the nozzle 4 in FIG. 1 has a deflection region 10. A nozzle outlet 9 of the nozzle 4 follows along the deflection region 10 on the downstream side. The nozzle outlet 9 is configured, aligned and disposed relative to the deflection region 10 in such a way that at the nozzle outlet 9 any flow pulse in the direction of the second sub-area 7 of the component 2 is prevented.

In FIG. 1 it is also shown that the deflection region 10 of the nozzle 4 extends towards and at least partially below a partition wall 11, which delimits the first sub-area 6 of the component 2 from the second sub-area 7 of the component 2 (thermally). The partition wall 11 is formed here by way of example as part of a nozzle box 19 in which a heat source 20 is (thermally) kept separate or isolated from the nozzle 4. The partition wall 11 helps to (thermally) seal off the nozzle 4 and the first sub-area 6 of the component 2 from the heat source 20, and thus to (thermally) delimit the first sub-area 6 of the component 2, which is cooled by means of the nozzle 4, from the second sub-area 7 of the component 2, which is heated by means of the heat source 20, so that different component temperatures can be established in the sub-areas 6, 7, leading to different grain structure and/or strength properties in the sub-areas 6, 7 of the component.

In addition, it is shown in FIG. 1 that the nozzle 4 in FIG. 1 is designed such that the fluid stream 5 produces a negative pressure area 12 on a side of the nozzle 4 pointing towards the processing plane 3 and on an area of the nozzle 4 which points towards a second sub-area 7 of the component 2. In addition, it can be seen in FIG. 1 that a distance between the processing plane 3 and the nozzle 4 is established such that the nozzle 4 does not contact the component 2.

In addition to the nozzle 4, which is designed as tangential nozzle 13, the tempering station 1 here has a further nozzle 18. The further nozzle 18 is exemplified in the manner of a shower and held next to the tangential nozzle 13 in the tempering station 1.

Figure 2:
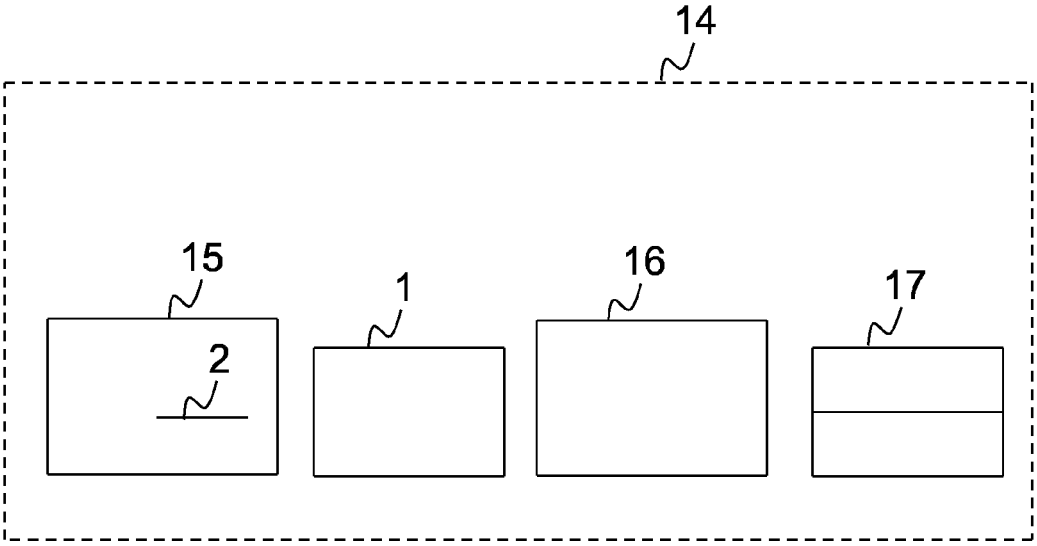
FIG. 2: a schematic representation of an apparatus according to the invention.

FIG. 2 shows a schematic representation of an inventive device 14 for heat treating a metal component 2. The apparatus 14 has a heatable first furnace 15, a tempering station 1 (directly) disposed downstream of the first furnace 15, a heatable second furnace 16 (directly) disposed downstream of the tempering station 1, and a press-hardening tool 17 (directly) disposed downstream of the second furnace 16. The apparatus 14 here represents a thermoforming line for (partial) press hardening. The press-hardening tool 17 is part of a press or is composed of a press.

A tempering station and a device for the heat treatment of a metal component are disclosed herein, which at least partially resolve problems identified by the prior art. In particular, the tempering station and the apparatus allow a transition region to be established as reliably and/or precisely as possible between the different heat-treated sub-areas of the component, in particular to be made as small as possible. In addition, the tempering station and the device in particular eliminate the need for the component to make contact with a partition wall provided for (thermal) delimitation of the differently tempered sub-areas of the component.

LIST OF REFERENCE NUMBERS

1 Tempering station
2 Component
3 Processing plane
4 Nozzle
5 Fluid stream
6 First sub-area
7 Second sub-area
8 Nozzle geometry
9 Nozzle exit
10 Deflection area
11 Partition wall
12 Negative pressure area
13 Tangential nozzle
14 Apparatus
15 First furnace
16 Second furnace
17 Press-hardening tool
18 Further nozzle
19 Nozzle box
20 Heat source

The invention claimed is:

1. A tempering station for the partial heat treatment of a metal component, comprising a processing plane disposed in the tempering station and in which the component is disposed, the component defining at least a first sub-area and a second area, wherein at least one tangential nozzle is provided and adapted for discharging a fluid stream for cooling at least the first sub-area of the component; wherein an outlet of the at least one tangential nozzle is designed such that a flow pulse in the direction of the second sub-area of the component is prevented at the nozzle outlet.

2. The tempering station according to claim 1, wherein a nozzle geometry of the at least one tangential nozzle is designed such that at least one element of the fluid stream flowing in the direction of the second sub-area of the component is deflected towards the first sub-area.

3. The tempering station according to claim 1, wherein the nozzle geometry of the at least one tangential nozzle is designed in such a way that at least one element of the fluid stream flows through the at least one tangential nozzle initially in one direction towards the second sub-area of the component and then is deflected towards the first sub-area.

4. The tempering station according to claim 1, wherein the nozzle geometry of the at least one tangential nozzle is designed such that the fluid stream first flows through the at least one tangential nozzle in one direction towards the second sub-area of the component and is then deflected towards the first sub-area.

5. The tempering station according to claim 1, wherein the nozzle outlet of the at least one tangential nozzle has a deflection region which extends towards and/or at least partially below a partition wall which separates the first sub-area from the second sub-area of the component.

6. The tempering station according to claim 1, wherein the nozzle outlet of the at least one tangential nozzle is designed such that the fluid stream generates a negative pressure area at a side pointing towards the processing plane and/or at a region of the at least one tangential nozzle pointing towards the second sub-area of the component.

7. The tempering station according to claim 1, wherein a distance between the processing plane and the at least one tangential nozzle is adjustable such that the at least one tangential nozzle does not contact the component.

* * * * *